United States Patent [19]

Malmer

[11] 3,986,696

[45] Oct. 19, 1976

[54] ANIMATED GARMENT HANGERS

[76] Inventor: Albert E. Malmer, P.O. Box 153, Blue Island, Ill. 60406

[22] Filed: Oct. 27, 1972

[21] Appl. No.: 301,627

[52] U.S. Cl. ..... 248/292; 46/37; 46/116

[51] Int. Cl.[2] ..... F16M 13/00

[58] Field of Search ..... 46/116, 37; 40/322, 40/70 R; 116/131, 132, 134; 35/23; 248/123, 292, 293, 294, 304, 364

[56] References Cited

UNITED STATES PATENTS

| | | | |
|---|---|---|---|
| 703,742 | 7/1902 | Salmond | 248/294 |
| 992,746 | 5/1911 | Ashdown | 248/306 X |
| 1,368,184 | 2/1921 | Merck | 248/292 X |
| 2,710,489 | 6/1955 | Myers | 248/304 X |
| 2,965,978 | 12/1960 | Olson | 35/23 R |

FOREIGN PATENTS OR APPLICATIONS

| | | | |
|---|---|---|---|
| 41,072 | 8/1926 | Norway | 40/70 R |
| 240,062 | 9/1925 | United Kingdom | 40/322 |

*Primary Examiner*—William H. Schultz

[57] ABSTRACT

An animated garment hanger in the form of a wall plaque with facial features which normally express a frown, but show a smile when the plaque is rotated sidewise in either direction to an inverted position. When the plaque is normally positioned a peg projects forwardly from its top portion; and a garment or garment-supporting hanger hung on the peg rotates the plaque as stated. The plaque also carries a counterweight which automatically turns the plaque back to the original position when the garment or garment-supporting hanger is removed from the peg.

6 Claims, 4 Drawing Figures

ANIMATED GARMENT HANGERS

This invention relates to novelties having an amusement factor and designed to set a good example, and particularly to garment hangers in the form of a figured plaque presenting a frowning image before a garment is hung, and a smiling one after it has been hung. Such hangers of this nature as have come to my attention embody a mechanism which normally maintains facial features of the plaque with a frown, the weight of a garment suspended from the hanger operating the mechanism to alter the facial features into a smiling expression.

A hanger of the above type, while designed as a fascinating novelty, is mainly intended for use by children to reward them with a smiling image when they have made it a habit to hang up their clothes; and the plaques of the types herein considered are usually made with a hook for directly hanging the garment or supporting a wire or wooden garment-supporting hanger.

As a facility having limited use, a hanger of the above type must be simple in order to sell at a low price. It is therefore one object of the present invention to depart from the use and expense of a mechanism to produce and change the facial expression mentioned, and provide a plaque which does not incorporate any mechanism for that purpose, while accomplishing the desired animated functions.

A further object is to design the plaque for normally presenting a frowning facial expression, and so shape the facial features that rotating the plaque sidewise — either way — will invert the facial features to present a smile.

Another object is to construct the hanger in the form of a thin plaque which may be hung on a wall to lie close thereto at all times, whether its expression is with a frown or a smile.

A still further object is to journal the plaque in the central region on a stud projecting from a thin wall plate, and project a peg from the plaque near the top for hanging a garment or garment-supporting hanger, this action causing the plaque to rotate as previously mentioned to an inverted position.

A final object is to provide means for automatically turning the plaque back to the original position when the garment or garment-supporting hanger is removed from the peg.

A better understanding of the invention may be gained by reference to the accompanying drawings, in which FIG. 1 is a face view of the hanger, partly in section on the line 1—1 of FIG. 2;

Figure 1:
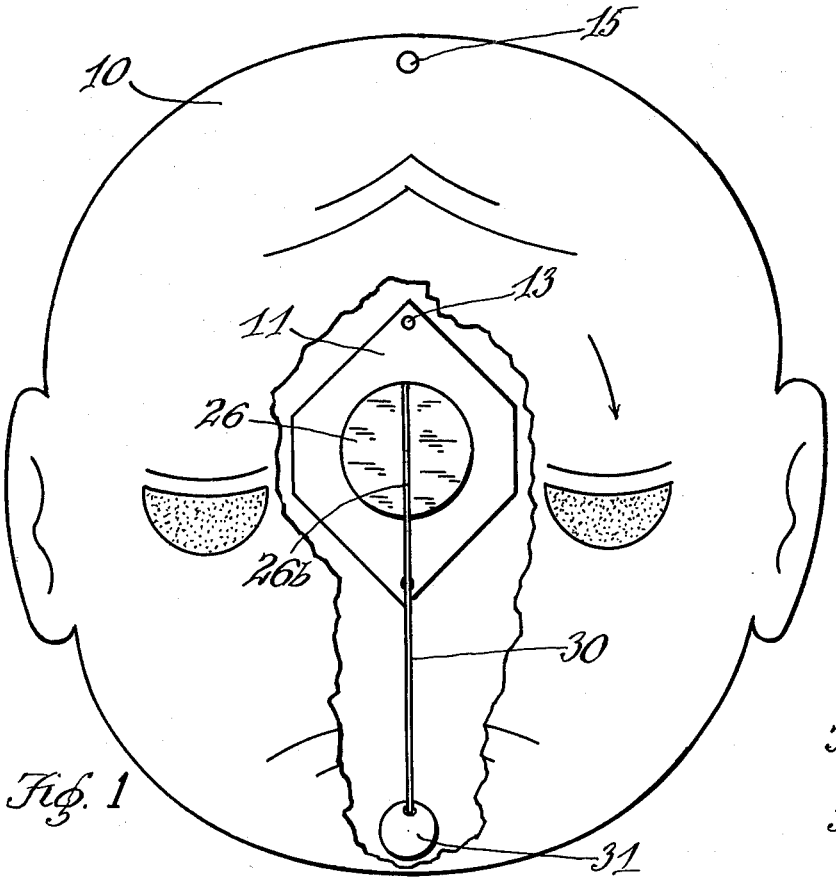
Figure 3:
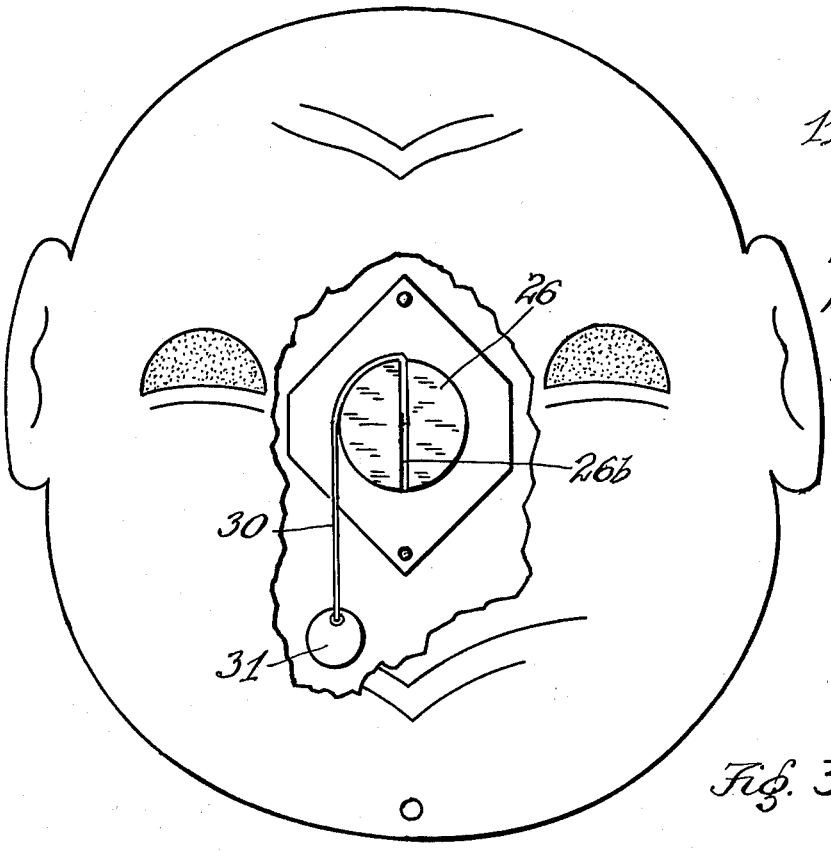
FIG. 3 is a view similar to FIG. 1, with the position of the hanger changed to express a smile.
Figure 4:
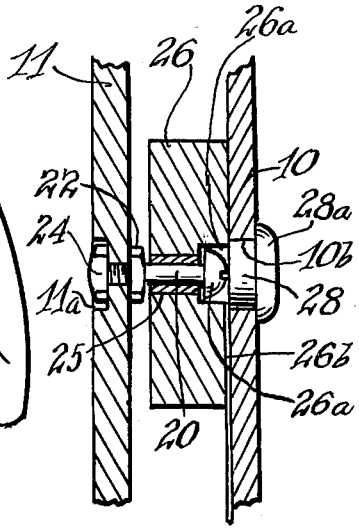
FIG. 4 is an enlargement of the central portion of FIG. 2 in vertical section.

Referring specifically to the drawings, 10 denotes the main portion of the garment hanger, which is a plaque of substantially circular form printed with features which depict a frowning facial expression when the garment hanger is positioned as in FIG. 1 and not in use. However, the facial features of the plaque are designed to depict a smiling expression when the plaque is inverted from the position of FIG. 1, as seen in FIG. 3.

The plaque 10 is designed for support on a wall or other vertical object. It is therefore carried by a stationary plate 11 which is attached to a wall 12 by means of nails or screws 13. In the form of the invention illustrated in FIGS. 1 to 3, a stud 14 projects from the plate 11 through the plaque 10 to journal it for lateral rotation, so that when it is given a half-turn from the position of FIG. 1, it will assume the position of FIG. 3.

Figure 2:
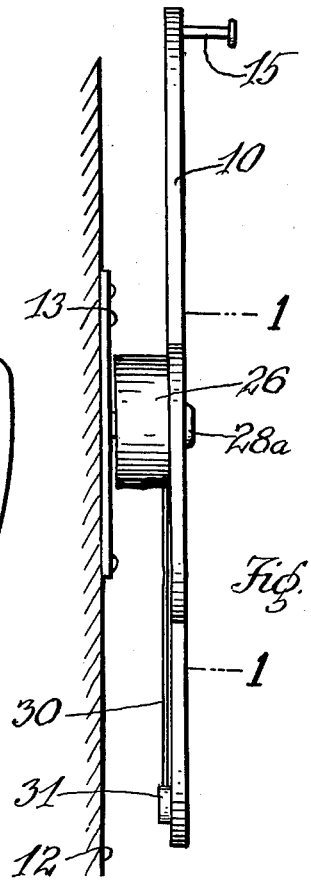
FIG. 2 is an edge view of the showing in FIG. 1, from the left-hand side.

When in its original position the plaque has a peg 15 near the top extending in forward direction as shown in FIG. 2. The peg is in readiness to have a garment or a garment-supporting hook hung on it. This action draws in the peg 15 to rotate the plaque 10 a half-turn either way as mentioned before, in which event the facial expression on the plaque changes from a frown to a smile. This expression lasts as long as the garment remains hung; and the hanger is designed to return by itself to the original position and the frowning expression when the garment is removed.

The plaque is designed for axial support on the wall plate 11. Thus, a horizontal bolt 20 is directed through a central opening **10*b* in the plaque to screw through a lock nut 22, pass through the wall plate 11, and receive a securing nut 24 seating in a rear cavity 11*a* of the wall plate. The plain shank of the bolt passes freely through a bushing 25 fitted tightly in a drum 26 which is attached rigidly to the back side of the plaque 10. The head 20*a* of the bolt is situated in a circular drum cavity 26*a*; and the drum is now free to rotate with a slight amount of end-play between the lock nut 22 and the head 20*a* of the bolt. The bolt head is concealed from frontal view by a plug 28 pressed into the frontal opening 10*b* and formed with a button-like head 28*a*** on the outside.

The plaque-journaling unit just described is assembled before the plug 28 is fitted — by advancing the bolt 20 alone through the bushing 25, threading the lock nut 22 on the bolt to a point close to the drum 26, advancing the bolt through the wall plate 11 to be flush with the back of the same, and screwing the nut 24 on the end-portion of the bolt to a tight extent. The plug 28 is then fitted to conceal the bolt head and present a neat external appearance. While the hanger is now assembled permanently to all intents and purposes, the plug is nevertheless removable in case the hanger is desired taken apart for inspection, lubrication of its bearing or repair.

The plaque is ordinarily maintained in the position of FIG. 1 — with a frowning expression — by a plumb line 30 suspending a weight 31. The plumb line is in the center of the plaque; and its upper portion is sealed in a vertical groove **26*b* cut in the outer face of the drum 26 and therefore permanently embedded between the latter and the plaque. Positioned as in FIGS. 1 and 2 the plump line maintains the plaque as shown in these views. However, when the plaque is rotated sidewise, to the right, by the hanging of a garment or garment-supporting hanger on the peg 15, FIG. 3 shows that the plumb line is raised by becoming wrapped part-way around the drum 26. Obviously, the same action occurs in case the plaque is turned toward the left. In the elevated position the plumb line functions as a counterweight, and therefore acts on the removal of the garment or garment-supporting hanger from the peg 15** to turn the plaque back to the original position.

It will now be apparent that the present animated garment hanger is a facility which is mounted and lies close to the wall or other vertical support at all times, and is rotated only sidewise to change the facial expression of the plaque. Further, the latter carries no mechanism for making the change, but procures it by a mere side turn to the inverted position. Further, the plaque carries its own counterweight to automatically return the plaque to the original position when it is no longer used for hanging a garment or garment-supporting hanger. Finally, the construction of the device is simple and its parts few.

I claim:

1. An animated garment hanger comprising a plaque designed for mounting in front of a wall or like support, means in the central region of the plaque journaling the same for lateral rotation, a garment-suspending facility at the top of the plaque, and facial features on the latter normally depicting a frowning expression, such features depicting a smiling expression when the plaque has been rotated to an inverted position by suspending a garment from said facility, said means comprising a wall plate, a bolt projecting from the same, a drum carried by the plaque on the rear side and centrally journaled on the bolt, and a plumb line depending from the drum and adapted to be wound on its periphery when the plaque is rotated as stated, the plumb line effective as a counterweight to turn the plaque back to the original position when the the garment is removed from said facility.

2. The garment hanger according to claim 1 wherein the drum has a groove facing the rear side of the plaque, and the upper portion of the plumb line is firmly lodged in said groove.

3. The garment hanger according to claim 2 wherein the upper portion of the plumb line is firmly lodged and sealed in said groove.

4. The garment hanger according to claim 1 wherein the plaque has a frontal opening for the insertion of said bolt through said drum and a removable frontal plug is pressed into said opening.

5. The garment hanger according to claim 4 wherein the shank of said bolt is threaded into a recess in the back of the wall plate, a spacer is positioned between said plate and said drum, and a nut is seated in said recess to be threaded on the end portion of said bolt shank.

6. The garment hanger according to claim 5 wherein a lock nut is threaded in the bolt shank between the wall plate and the drum and a nut is seated in said recess to be threaded onto the end portion of said bolt shank.

* * * * *